313-422 SR
5/14/85 OR 4,517,489

United States Patent [19]

Glock et al.

[11] Patent Number: 4,517,489

[45] Date of Patent: May 14, 1985

[54] MODULATOR STRUCTURE AND METHOD FOR FLAT PANEL DISPLAY DEVICES

[75] Inventors: Thomas L. Glock, Allentown; Thomas L. Credelle, Lawrenceville, both of N.J.

[73] Assignee: RCA Corporation, Princeton, N.J.

[21] Appl. No.: 534,709

[22] Filed: Sep. 22, 1983

[51] Int. Cl.[3] ..... H01J 29/52

[52] U.S. Cl. ..... 313/422; 445/24; 445/47; 445/49; 445/52

[58] Field of Search ..... 313/422; 445/24, 47, 445/49, 52

[56] References Cited

U.S. PATENT DOCUMENTS

| | | | |
|---|---|---|---|
| 4,199,705 | 4/1980 | Anderson et al. | 313/422 |
| 4,217,519 | 8/1980 | Catanese et al. | 313/422 X |
| 4,316,118 | 2/1982 | Anderson et al. | 313/422 |

*Primary Examiner*—Arthur Kellogg
*Attorney, Agent, or Firm*—E. M. Whitacre; D. H. Irlbeck; L. L. Hallacher

[57] ABSTRACT

A modulator assembly for a flat panel display device is fabricated with a single piece substantially U-shaped isolation member. The modulation electrode pairs are formed as bifilar strips configured singularly to and insulatively affixed to the isolation member.

8 Claims, 4 Drawing Figures

MODULATOR STRUCTURE AND METHOD FOR FLAT PANEL DISPLAY DEVICES

BACKGROUND OF THE INVENTION

This invention relates generally to flat panel display devices and particularly to a modulator structure for such devices and to a method of making such structure.

Prior art flat panel display devices, such as those described in U.S. Pat. Nos. 4,316,118 and 4,199,705, both to C. H. Anderson et al. include a baseplate and a faceplate which are held in a spaced parallel relationship by a plurality of external side walls. A phosphor screen is arranged on the faceplate to produce the desired image when struck by electrons. The envelope is divided into a plurality of channels by internal walls which provide support against collapse due to atmospheric pressure. Each of the channels includes a guide mesh structure along which electron beams propagate the lengths of the channels until one line of the visual display is to be produced. The electrons are emitted from a cathode which is arranged at the entrance to each guide mesh structure. Pairs of modulation electrodes overlap the cathodes so that each electron beam can be individually modulated to produce the desired image on the screen. Interaction of the modulation voltages on adjacent pairs of modulation electrodes is avoided by the use of isolation electrodes between the modulation electrodes. The isolation electrodes are all biased at the same constant voltage. The constant electric field produced by the isolation electrodes prevent the varying electric fields of the modulation voltages from interacting and adversely affecting the modulation of the electron beams.

Flat panel display devices built in accordance with the prior art operate satisfactorily for the purposes intended. However, difficulties sometimes arise because it is essential that the modulation electrodes in each pair are electrically connected. In the device of U.S. Pat. No. 4,199,705, for example, the modulation electrodes are placed onto separate pieces and subsequently bonded together to form the electrical contact. It is possible for the bond to separate during subsequent processing or due to heat expansion during operation. Problems can also arise because electrons can charge the insulative substrate which supports the electrodes and cause the modulation and isolation electrodes to short together. It is also possible for the barium used in the getter flashing or from the cathode to short out the modulation and isolation electrodes. Additionally, the fabrication of the modulator described in U.S. Pat. No. 4,199,705 is expensive and difficult.

There, therefore, is a need for a modulator structure, and method of fabrication, which assures electrical contact of the modulator electrodes in each pair, which assures electrical separation of the modulation electrodes and the isolation electrodes and which is inexpensive to reliably fabricate. The instant invention fulfills this need by the provision of a modulator structure and method which assures the integrity of the electrical contact of the electrodes in each modulator electrode pair and by the provision of an isolation electrode which covers all exposed insulators in the cathode region.

SUMMARY OF THE INVENTION

An improved modulation assembly for a display device having a cathode for supplying electron beams includes a modulator assembly for modulating the electron beams with video information. The modulation assembly includes an isolation electrode formed as a single substantially U-shaped member and modulation electrodes comprised of bifilar conductive strips configured similarly to the U-shaped member and insulatively affixed to the U-shaped member.

DETAILED DESCRIPTION OF THE PREFERRED EMBODIMENT

Figure 1:
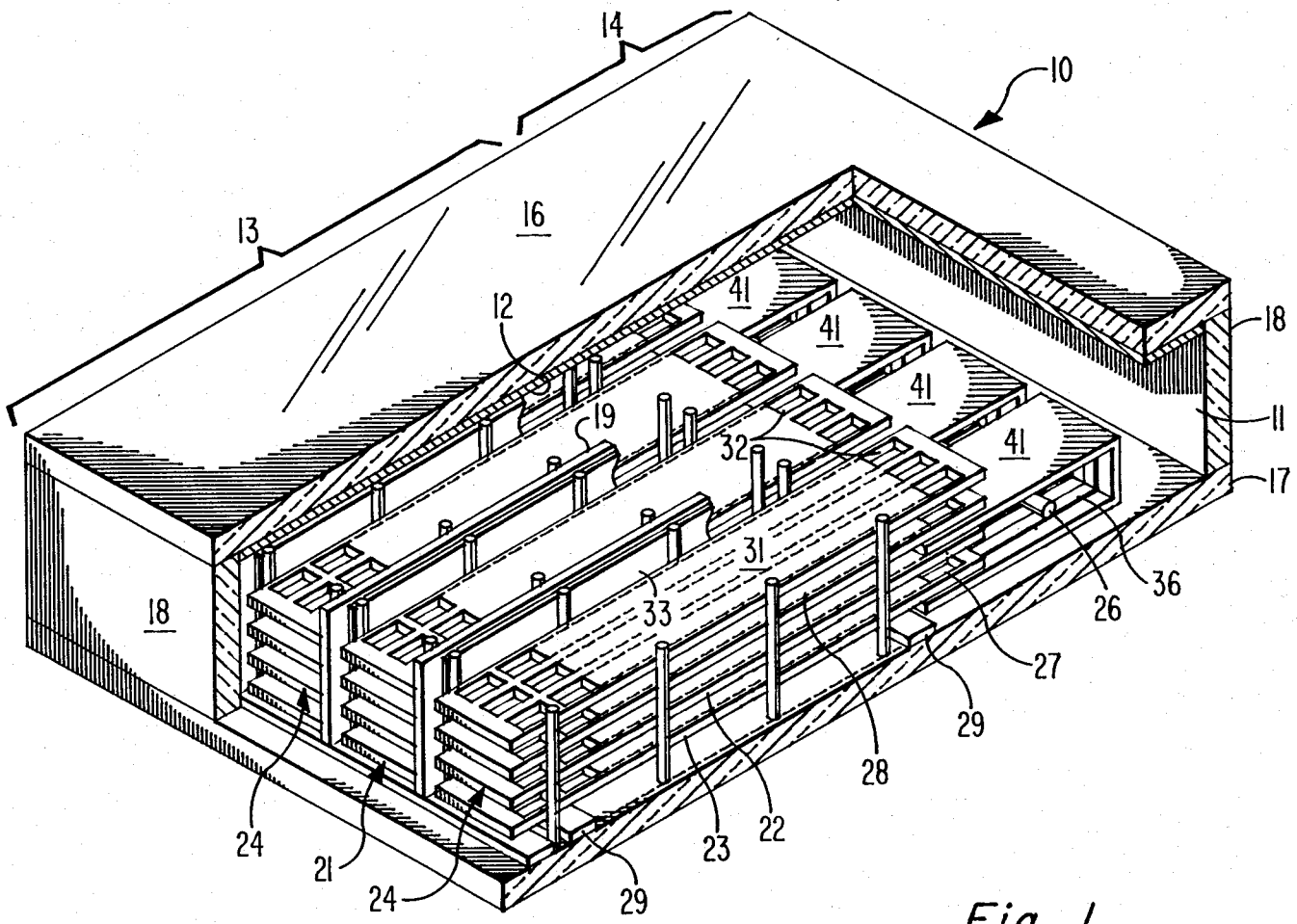
FIG. 1 is an isometric view, partially broken away, of a flat panel display device incorporating the preferred embodiment.

FIG. 1 shows a flat panel display device 10 incorporating the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs of each channel. An individual cathode can be used for each electron beam of the device, a number of cathodes can be used to provide the electrons needed for several beams, or a single line cathode can be used to produce the electrons for all the beams. The guide meshes 22 and 23 include apertures 27 which are arranged in columns longitudinally along the channels 21 and in rows transversely across the channels when three electron beams are used. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 32 which also are aligned in columns longitudinally of the channels and in rows transversely of the channels. Scanning electrodes 33 are arranged on both sides of the support vanes 19 so that each vane supports a scanning electrode for two adjacent channels. Modulation electrodes 36 and isolation electrodes 41 overlap the cathode 26.

In operation, the cathode 26 emits electrons into the spaces 24 between the meshes 22 and 23. Modulation voltages are applied to the modulation electrodes 36 to cause the electron beams to produce the desired image on the screen 12. The isolation electrodes 41 are biased more negatively than the cathode 26 to prevent electron emission between the columns of apertures 27. Additionally, the isolation electrodes prevent the different modulation voltages on adjacent modulation electrodes 36 from interacting. The electron beams propagate in the spaces 24 between the guide meshes 22 and 23 until the production of one horizontal line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the focus mesh 28 and the acceleration mesh 31. The extracted electron beams are horizontally scanned across the channels 21 by the application of varying voltages, such as sawtooth waveforms, to the scanning electrodes 33 on the sides of the support vanes 19. Every channel therefore is horizontally scanned between the two support vanes 19 so that each channel contributes a portion of each horizontal line of the visual display on the faceplate 16.

Figure 2:
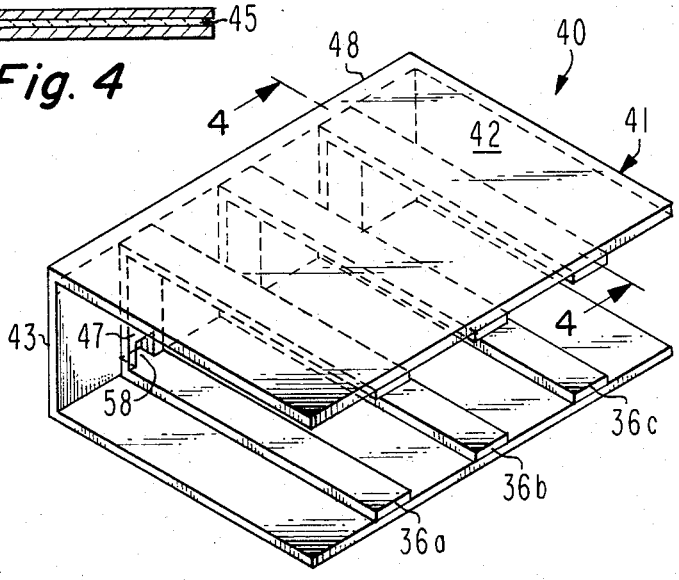
FIG. 2 is an isometric view, of a preferred embodiment.

A preferred embodiment of a modulator assembly 40 is shown in FIG. 2. The isolation electrodes 41 for each of the channels 21 are fabricated from a single piece of conductive material 42 which is formed into a substantially U-shaped member. The closed end 43 can be flat as shown or rounded depending primarily upon fabrication convenience. Each of the modulation electrodes **36*a*, 36*b* and 36*c* is fabricated from a single conductive strip which is shaped into a bifilar conductor and configured similarly to the configuration of the U-shaped isolation electrode 41**. Thus, the invention replaces the four pairs of isolation electrodes of U.S. Pat. No. 4,199,705 with a single electrode, and the three pairs of modulation electrodes with three bifilar strips.

Figure 4:
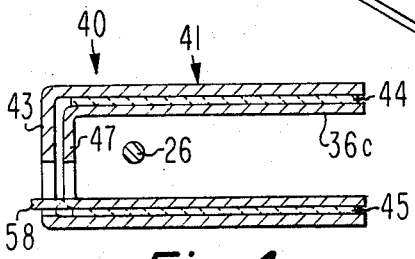
FIG. 4 is a cross-section view taken along line 4—4 of FIG. 2.

In FIG. 4, the modulation electrode **36*a* is affixed to the U-shaped isolation member 41 by layers 44 and 45 of an insulative adhesive, such as frit or pyralin. The insulative material is omitted from the space 46 between the closed ends 43 and 47 of the isolation member 41 and the modulation electrode 36*a* respectively. This is primarily for fabrication convenience and, if desired, or if necessary to avoid voltage arcing between the isolation member 41 and the modulation electrode 36*a*, the insulative material can be placed into the space 46**.

In FIG. 2, three modulation electrodes **36*a*, 36*b* and 36*c* are shown and, accordingly, three electron beams are generated and propagated along each of the channels 21 of the display device 10 (FIG. 1) to produce a color image on the screen 12. Accordingly, the transverse dimension along the edge 48 of the modulator assembly 40 is substantially equal to the transverse dimension of each of the channels 21. However, if desired, the isolation member 41 can be dimensioned to transversely span a plurality of the channels 21** or in the alternative can extend completely across the transverse dimension of the display device.

Figure 3:
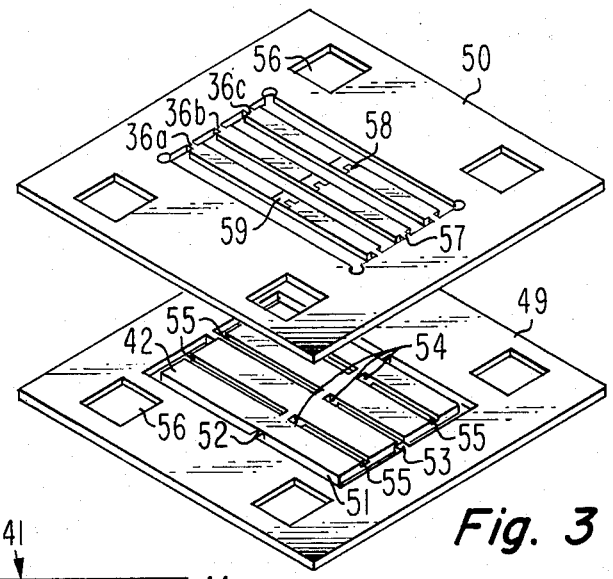
FIG. 3 is an isometric view of the pieces used to fabricate the preferred embodiment of FIG. 2.

FIG. 3 shows a first blank piece of material 49 from which the isolation member 42 is formed and a second blank piece of material 50 from which the modulation electrodes **36*a*, 36*b* and 36*c* are formed. A slot 51 is formed through the isolation blank 49 in a substantially rectangular configuration by etching or some other convenient method. A few small areas of material, such as 52 and 53, remain to prevent the isolation blank 42 from being completely separated from the piece 49. When acid etching is used, the electrode patterns are applied to the blanks 49 and 50 using known photographic techniques. Apertures 54 are provided completely through the blank 49 along the bend line where bending will occur during the formation of piece 49 into the U-shaped member. Additionally, some thickness of the material of the isolation blank 42 is removed along thinned areas 55 which correspond to the locations where the modulation electrodes 36*a*, 36*b* and 36*c* are subsequently affixed to the isolation member 42. Accordingly, the thinned areas 55 receive the insulative layers 44 and 45 of FIG. 4. Alignment holes 56 are provided in both the blanks 49 and 50 in any convenient pattern, and are used to accurately align the modulation electrodes 36*a*, 36*b* and 36*c*** with the thinned areas during propagation of the assembly.

The modulation electrodes **36*a*, 36*b* and 36*c* are formed by acid etching or some other method into the modulation blank 50. The modulation electrodes 36*a*, 36*b* and 36*c* are made as single conductive strips which are contained in the blank 50 by small sections of material 57 at both ends. Apertures 59 are provided in each of the strips. The apertures 59 are configured to leave tabs 58 (FIGS. 2 and 4) when the strips are bent into the bifilar configuration. The apertures 59 and the tabs 58 are located in the modulator strips to coincide with the apertures 54 in the isolation electrode blank 42**.

In fabricating the invention, the layers 44 and 45 of insulative material (FIG. 4) are placed on the thinned areas 55 on the isolation blank 42. The alignment holes 56 in the isolation blank 49 and the modulation blank 50 are aligned using alignment pins or some other convenient technique, to precisely position the modulation members **36*a*, 36*b* with respect to the thinned areas 55. After the modulation blank 50 is positioned on the isolation blank, the insulative material is hardened by baking if a frit material is used, to permanently affix the two blanks 49 and 50. The small areas of retention metal 52, 53 and 56 are broken away to separate the modulation electrodes 36*a*, 36*b* and 36*c* and the isolation electrodes 41 from the blanks 49 and 50. The sandwich-like assembly is then bent along appropriately positioned bend lines to form the structure into the U-shaped configuration shown in FIGS. 2 and 4. One of the bend lines is positioned in the vicinity of the apertures 54 and 59. Accordingly, during bending, the tabs 58 of the modulation electrodes pass through the apertures 54 in the isolation member 41 so that the tabs 58 extend through the closed end 43 of the isolation member 41 (FIGS. 2 and 4). The tabs 58 provide a convenient mechanism for connecting the modulation electrodes electrodes to the video signals required to produce a visual display on the screen 12**.

What is claimed is:

1. In a display device having an envelope divided into channels by a plurality of internal support walls, cathode means for supplying electrons for propagation as beams along said channels, and a modulation assembly for modulating said electron beams with video information, said modulation assembly including a pair of electrically connected modulation electrodes arranged on opposite sides of said cathode means for each of said electron beams, and isolation electrode means for electrically separating said pairs of modulation electrodes; an improved modulation assembly wherein:

said isolation electrode means comprises a single substantially U-shaped member; and each pair of said modulation electrodes is comprised of a bifilar conductive strip configured similarly to said U-shaped member and insulatively affixed to the inside surface of said U-shaped member.

2. The modulator means of claim 1 wherein said U-shaped member has a transverse dimension substantially equal to the transverse dimension of one of said channels.

3. The modulator means of claim 1 wherein said U-shaped member spans a plurality of said channels.

4. The modulator means of claim 1 wherein said U-shaped member spans all of said channels.

5. The modulator means of claim 4 wherein said U-shaped member includes shaped apertures, and wherein said bifilar strips contain tabs extending through said apertures, whereby electrical connections can be made to said tabs.

6. A method of making a modulator assembly for modulating electron beams in a display device comprising the steps of:

forming an isolation member in a first blank of material;

forming a plurality of modulation electrode strips in a second blank of material;

insulatively affixing said strips to said isolation member;

separating said strips and said isolation member from said second and first blanks of material;

bending said isolation member and said strips to form a substantially U-shaped modulator assembly having said modulation electrodes on the inside surface of said isolation member.

7. The method of claim 6 further including the step of placing a plurality of apertures in said isolation member along the line on which bending occurs;

forming tabs in said strips along the line on which bending occurs; and aligning said tabs and said apertures whereby said tabs extend through said apertures when said assembly is bent.

8. The method of claim 7 further including the step of thinning said first blank of material in the locations where said modulation electrode strips are affixed to said isolation member.

* * * * *